United States Patent [19]

Schwendt

[11] 4,114,512

[45] Sep. 19, 1978

[54] STABILIZED TURRET

[75] Inventor: Lutz Schwendt, Vellmar, Germany

[73] Assignee: Thyssen Industrie Aktiengesellschaft, Essen, Germany.

[21] Appl. No.: 124,428

[22] Filed: Mar. 15, 1971

[30] Foreign Application Priority Data

Mar. 25, 1970 [DE] Fed. Rep. of Germany ..... 2014389

[51] Int. Cl.[2] ..... F41H 5/20

[52] U.S. Cl. ..... 89/36 K; 89/37 G

[58] Field of Search ..... 89/36 H, 36 K, 36 L, 89/37 G, 37.5 A, 40 B, 40 C, 41 T, 41 CE

[56] References Cited

U.S. PATENT DOCUMENTS

| | | | |
|---|---|---|---|
| 2,712,271 | 7/1955 | Wabnitz | 89/36 K |
| 2,762,265 | 9/1956 | Kuijvenhoven | 89/36 H |

*Primary Examiner*—Stephen C. Bentley
*Attorney, Agent, or Firm*—Spencer & Kaye

[57] ABSTRACT

A triaxially stabilized armored turret for light weapons, and in particular automatic weapons, wherein the cardanic suspension point of the turret is located vertically between the bore axis of the horizontally aligned weapon and the roof of the turret well at a height of 30–70 percent of the vertical distance therebetween whereby the height of the turret may be kept relatively low while still providing a relatively large opening at the bottom. The weapon is preferably mounted within the turret so that it can be elevated, independent of the movement of the turret, about a separate elevation axis, which, when seen in the firing direction, lies in a vertical plane which is in front of the cardanic suspension point at a horizontal distance such that the recoil moment of the weapon at both its highest and lowest elevations is approximately the same. The seats for the gun crew, and if necessary an additional auxiliary weapon and its ammunition, are disposed to the rear of the turret so as to provide compensation for the weight of the primary weapon and any required reinforced armor on the front of the turret so that the center of gravity of the entire turret moves horizontally over a range which is symmetrically disposed with respect to the cardanic suspension point as the weight of the turret changes between its fully loaded or armed state and its empty state.

8 Claims, 4 Drawing Figures

STABILIZED TURRET

BACKGROUND OF THE INVENTION

The present invention relates to a triaxially stabilized armored turret for light weapons, particularly for automatic type weapons.

In such turrets, which are generally known in the art, it is necessary for the weapons and the ammunition and the gun crew for the weapons to be accommodated within the turret. Additionally, no interfering external moments should have any influence on the stabilization of the turret.

It is known to provide a triaxially stabilized turret for an armored vehicle in which the outer shell of the turret in the region of the vehicle roof, i.e. the side wall of the turret, is designed to be spherical with respect to its cardanic suspension. In order to avoid deflecting moments resulting from the transmission of the recoil of the weapon barrel to the turret, which deflecting moments additionally stress the stabilization alignment drives particularly during continuous fire, the weapon is disposed in the turret so that its bore axis passes through the point of cardanic suspension. This type of weapons arrangement will be referred to as a "concentric weapons arrangement" hereafter.

When designing such turrets for lightweight, and thus small sized, weapons and for one or two gunners, it is desirable to build the turret with as small a spherical diameter as possible, in order to keep its silhouette small.

This type of turret design with a concentric weapons arrangement, however, has the drawback that due to the pivoting movement of the turret in all directions with respect to the vehicle, the lower spherical portion of the turret shell extends very close to the vertical axis of the turret. This results in only a small lower opening being available in the turret shell for passage of the suspension or support members of the turret, which, for reasons of the ballistic protection thereof are advisably accommodated inside the turret shell.

A further drawback of this type of turret design is that the crew members cannot put their feet into the vehicle interior disposed therebelow alongside the suspension members for the turret because the lower opening in the turret shell is too narrow and thus they can only sit in the turret in a very uncomfortable position with their knees raised high. This drawback can be eliminated by mounting the seats for the crew members at an appropriately high position in the turret but this would increase the height of the turret and cause its silhouette to become undesirably large.

In order to overcome the drawbacks of the above-mentioned turret design with a concentric weapons arrangement, one might consider disposing the cardanic suspension point below the bore axis of the weapon approximately at the height of the vehicle roof. The opening in the turret shell at the lowest point of the turret thus becomes large, the crew members have more room and can place their feet outside of the spherical turret portion and into the interior of the vehicle below.

The drawbacks of this type of design, however, are the high recoil of the weapon about the cardanic suspension point, which results from the distance of the cardanic suspension point from the bore axis of the barrel of the weapon, and the fact that in this design the turret roof is inevitably rather small which makes it impossible to mount any of the required sighting means.

SUMMARY OF THE INVENTION

It is the object of the present invention to provide an improved armored turret of the above-mentioned general type.

It is more particularly the object of the present invention to provide an improved triaxially stabilized armored turret for light weapons whose silhouette is as low as possible and yet has a relatively larger lower opening, and a larger vertical pivoting range, considering the center of gravity of the weapon, than the prior art turrets.

The above and other objects are accomplished according to the present invention in that the cardanic suspension point of the triaxially stabilized turret is disposed at a vertical height which is approximately between 30 and 70 percent of the vertical distance between the plane of the bore axis of the weapon when it is horizontally aligned and the roof of the vehicle well. With this arrangement the recoil moment of the weapon, the lower opening of the spherical turret portion and the size of the turret roof will be kept in acceptable orders of magnitude.

According to a further development of the inventive concept, the stronger the recoil, for example, as a result of a limitation of the return path of the weapon which might be required for other reasons, the closer the cardanic suspension point is vertically moved to the plane of the bore axis of the horizontally aligned weapon. Although this results in a decrease in the size of the lower turret opening, this slight decrease is overlooked in favor of the regulatory advantages of the sufficiently small recoil moment and the additionally resulting increase in the size of the turret roof.

In order to permit use of the weapon in the turret for anti-aircraft purposes without too severely limiting the lower opening in the turret shell, according to a further feature of the present invention, the weapon is mounted in the turret in a known manner so that it can be elevated independent of the movement of the turret. The elevation range of the actual turret is then preferably limited to approximately $\pm$ 13°.

According to a further feature of the embodiment of the invention comprising the separately or independently elevatable weapon, the elevation axis for the separate or independent elevation of the weapon is disposed in a vertical plane which is in front of the cardanic suspension point when seen in the firing direction. The result of this placement of the location of the elevation axis of the weapon relative to the cardanic suspension point is that with increasing elevation angle, the recoil moment of the weapon about the cardanic suspension point of the turret initially decreases until it becomes zero and then increases again with the opposite sign.

According to still a further development of the last-described arrangement, the horizontal spacing between the cardanic suspension point of the turret and the elevation axis for the independent weapon elevation is so selected that the positive and negative recoil moments are substantially identical at the lowest and highest elevation.

A further parameter of the turret, which should be considered in determining the horizontal spacing of the weapon elevation axis from the cardanic suspension point of the turret, is the position of the center of gravity of the entire turret in operational readiness.

Therefore, according to still a further feature of the invention, a preferred embodiment of the present invention is realized in that compensation for the weight of the main or primary weapon and any required forwardly reinforced armor on the turret is provided in a known manner by mounting a secondary weapon and its ammunition at or on the rearward turret portion and by seating the crew — insofar as possible within the available space — in the rear portion of the turret so that the center of gravity of the entire turret moves in a range which is disposed symmetrically with respect to the cardanic suspension point of the turret as the weight of the turret changes between its fully armed state and its state wherein all of the ammunition has been fired.

DESCRIPTION OF THE PREFERRED EMBODIMENT

Figure 1:
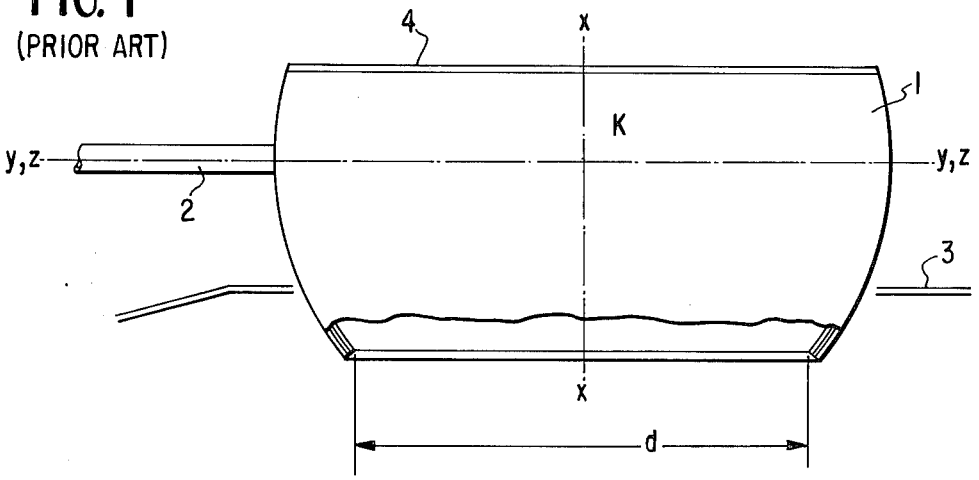
FIG. 1 (PRIOR ART)
FIGS. 1 to 3 are each schematic side views of an armored turret illustrating the effect of placing the cardanic suspension point at different heights.
Figure 2:
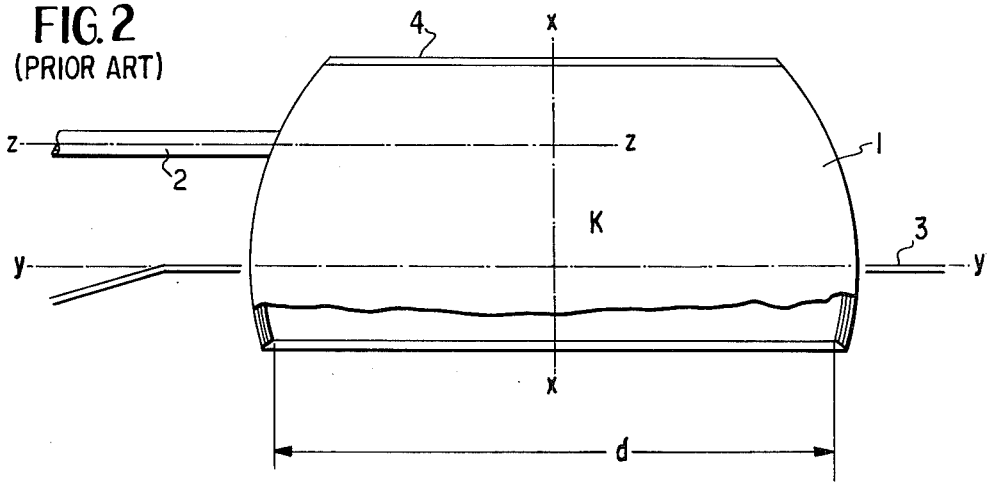
FIG. 2 (PRIOR ART)
Figure 3:
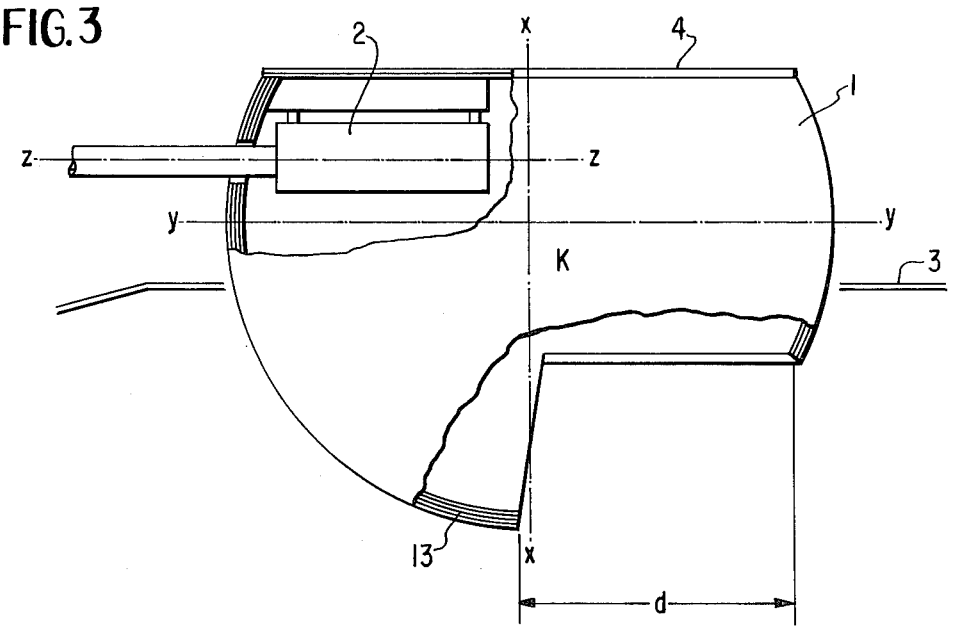

Before describing the preferred embodiment of the invention (FIG. 4), the effect of the vertical location of the cardanic suspension point ot the turret on the shape thereof is illustrated with a number of illustrations, i.e. FIGS. 1–3.

In each of the illustrated triaxially stabilized turret embodiments, the vertical axis of the turret is marked X—X and one of the two horizontal turret axes is marked Y—Y.

The three axes about which the turret 1 with its weapon 2 can be moved intersect at a point K which is called the cardanic suspension point of the turret. Additionally, the bore axis of the weapon is indicated by Z—Z and the same reference numerals are utilized in all figures for the same parts.

Referring now to FIG. 1, there is shown a triaxially stabilized armored turret 1 according to the prior art having a concentric weapons arrangement. That is, the bore axis Z—Z of the weapon 2 coincides with the horizontal axis Y—Y of the turret 1. The cardanic suspension point K is here disposed above the base, or well roof, 3 of a vehicle. The bore axis Z—Z of the weapon here passes through the cardanic suspension point K, thus minimizing the recoil moment, and the roof 4 of the turret 1 is large. However, in order to provide for a wide vertical pivoting range of the weapon 2, as mentioned above, the diameter *d* of the lower turret opening 12 is small, presenting the problems also mentioned above.

In the triaxially stabilized turret illustrated in FIG. 2, the axis Y—Y and the cardanic suspension point K are disposed approximately in the plane of the base or well roof 3 when the turret 1 is in its normal position relative thereto. The weapon 2 is arranged in the turret 1 at a vertical distance from axis Y—Y so that the bore axis Z—Z of the barrel of the weapon is disposed above the axis Y—Y of the turret and intersects only its axis X—X. As can easily be seen, with this arrangement, although the diameter *d* of the lower opening 12 of the turret 1 is increased, the roof 4 is decreased substantially. Additionally, as further pointed out above, this arrangement results in substantial increase in the recoil moment.

FIG. 3 illustrates a turret 1 with a rigidly installed weapon 2, in which the horizontal turret axis Y—Y, and consequently the cardanic suspension point K of the turret 1, are vertically disposed above the plane of the base 3 and below the plane of the bore axis Z—Z of the barrel of the weapon 2. Although with this general arrangement the size of the roof 4 and the bottom opening 12 could be kept within reasonable values if the weapon were to be utilized only for firing along the ground, a problem occurs if, as is the normal case, the weapon is also to be utilized for anti-aircraft purposes. As illustrated, due to the high turret elevation required for anti-aircraft purposes, large-area armor plating 13 for the forward portion of the spherical side wall of the turret is required in order to protect the interior thereof. This required armor plating 13 substantially limits the size of the lower turret opening 12.

Figure 4:
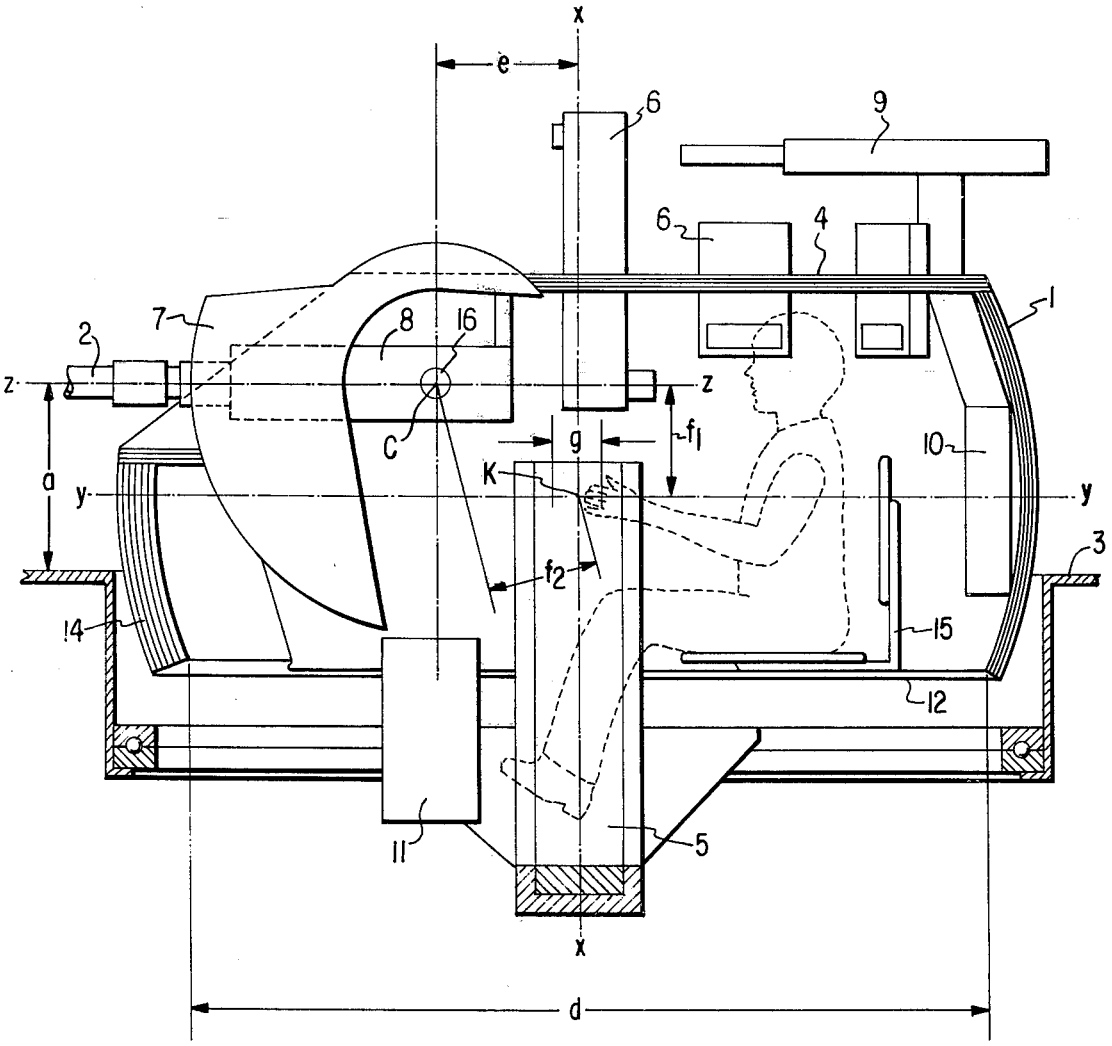
FIG. 4 is a vertical sectional view of the armored turret according to the preferred embodiment of the present invention.

Turning now to FIG. 4, there is shown a preferred embodiment according to the invention of a triaxially stabilized armored turret for light weapons and in particular automatic light weapons. As in each of the other figures, the turret 1, whose side walls are spherical with respect to the cardanic suspension point K of the turret, is mounted in a well-known manner in a well formed in the roof 3 of a vehicle so that the turret is triaxially stabilized. Additionally, as with the turret shown in FIG. 3, the axis Y—Y, and consequently the cardanic suspension point K of the turret 1, is vertically disposed above the plane of the well roof 3 and between the well roof 3 and the plane of the bore axis Z—Z of the weapon 2 when it is horizontally aligned. The vertical distance between the plane of the bore axis Z—Z of the weapon 2 and the roof 3 when they are horizontally aligned is indicated by the reference character *a* and, according to the invention, the axis Y—Y and the cardanic suspension point K are disposed at a vertical distance from the roof 3 of approximately 30–70 percent of the distance *a*. Since the recoil moment about the cardanic suspension point K is related to the distance thereof from the bore axis Z—Z, the stronger the recoil of the weapon 2, the closer the cardanic suspension point K is vertically moved, within the above range, to the plane of the horizontally aligned bore axis Z—Z of the weapon 2. By arranging the relationship between the bore axis Z—Z, the well roof 3 and the cardanic suspension point K of the turret as described, there results a triaxially stabilized armored turret 1 having a relatively large-area roof 4 as well as a large lower opening 12 of large diameter *d* through which the suspension members 5 of the turret 1 can be brought. As a result of the large opening 12, the feet of the turret crew can also extend through the lower turret opening, as shown in the drawing, into the area disposed therebelow. Moreover, as indicated, the roof 4 of turret 1 is sufficiently large so that all of the required sighting means 6 may be disposed thereon.

The weapon 2 is provided with a cylindrical mount 7 and the barrel is held in a known manner in a cradle 8. In order to allow the use of the weapon 2 for anti-aircraft fire and in order to avoid the need for the large-area forward armor as indicated in FIG. 3, the cradle 8 is mounted in the turret 1 in a known manner by means of two trunnions, one of which is indicated by the reference numeral 16, in such a manner that the weapon 2 can be elevated independently of the movement of the turret. The elevation axis formed by the two trunnions, which axis extends transverse to the bore axis Z—Z of the weapon 2, is indicated by the reference character C.

This elevation axis C is disposed in a vertical plane which is ahead or in front of the cardanic suspension point K when seen in the firing direction at a horizontal distance *e*. The distance *e* is here so selected that the distances *f*1 and *f*2 which correspond to the distance between the bore axis Z—Z and the cardanic suspension point K at the lowest and the highest elevation of the weapon, respectively, and which are proportional to the maximum recoil moments about the cardanic suspension point K, are approximately equal in value.

As indicated above, the position of the center of gravity of the entire turret 1 in its operational state should also be considered when determining the distance *e* to ensure that the center of gravity does not shift too far from the cardanic suspension point K. Accordingly, to provide compensation for the weight of the weapon 2 and any required additional armor plate 14 provided on the front side wall of the turret 1, an additional or secondary weapon 9 and its ammunition container 10 are disposed at the rear of the turret 1. Additionally, the seats 15 for the gun crew are disposed to the rear of the turret. The weapon 9, the ammunition containers 10, 11 and the seats 15 are specifically positioned in a known manner with respect to the distance *e*, so that the horizontal movement of the center of gravity of the turret moves within a range *g* which is symmetrically disposed to the cardanic suspension point K of turret 1 as the total weight of the turret changes between its fully armed state and the state when all the ammunition has been fired.

It will be understood that the above description of the present invention is susceptible to various modifications, changes and adaptations, and the same are intended to be comprehended within the meaning and range of equivalents of the appended claims.

I claim:

1. In an armored turret for light weapons, and in particular automatic weapons, said turret being mounted within a well in the roof of an armored vehicle so that it is movable about a plurality of mutually perpendicular axes one of which is a horizontal elevation axis, and having a primary weapon mounted in the front thereof, the improvement wherein: said turret is mounted in said well so that its cardanic suspension point is vertically disposed between said roof of said vehicle and the plane of the bore axis of said primary weapon when it is horizontally aligned and at a height between 30% and 70% of the vertical distance between the bore axis of the horizontally aligned primary weapon and said vehicle roof; the side wall of the outer shell of said turret is substantially spherical with respect to said cardanic suspension point; and said turret is open to said well along its entire lower end.

2. An armored turret as defined in claim 1 wherein said turret is mounted within said well so that its elevation range is limited to approximately ± 13°.

3. An armored turret as defined in claim 1 wherein the larger the recoil moment of said primary weapon, the closer said cardanic suspension point is vertically located to the bore axis of said weapon when it is horizontally aligned.

4. In an armored turret for light weapons, and in particular automatic weapons, said turret being mounted within a well in the roof of an armored vehicle so that it is movable about a plurality of mutually perpendicular axes one of which is a horizontal elevation axis, and having a primary weapon mounted in the front thereof, the improvement comprising: said turret being mounted in said well so that its cardanic suspension point is vertically disposed between said roof of said vehicle and the plane of the bore axis of said primary weapon when it is horizontally aligned and at a height between 30% and 70% of the vertical distance between the bore axis of the horizontally aligned primary weapon and said vehicle roof; and means for mounting said primary weapon within said turret so that it can be elevated about a separate elevation axis independent of the movement of said turret.

5. An armored turret as defined in claim 4 wherein said separate elevation axis of said primary weapon is disposed in a vertical plane which is in front of said cardanic suspension point in the firing direction.

6. An armored turret as defined in claim 5 wherein the horizontal distance between said cardanic suspension point of said turret and said separate elevation axis of said weapon is such that the amount of recoil moment at both the lowest and the highest elevation of said weapon is approximately the same.

7. An armored vehicle as defined in claim 6 further including: a secondary weapon mounted on the rear of said turret; ammunition containers for said weapons mounted within said turret; and at least one gun crew seat mounted in the rear of said turret, said secondary weapon, said ammunition containers and said at least one gun crew seat being positioned with respect to the said horizontal distance between said cardanic suspension point of the turret and the said elevation axis for said weapon so as to provide compensation for the weight of said primary weapon and any reinforced armor disposed at the front of said turret so that the horizontal movement of the center of gravity of the entire turret is within a range which is symmetrically disposed with respect to said cardanic suspension point as the weight of the turret changes between its fully armed state and its state wherein all of the ammunition has been fired.

8. An armored turret as defined in claim 4 wherein said turret is mounted so that it is movable about three mutually perpendicular axes.

* * * * *